US006572443B1

(12) United States Patent
Beckage et al.

(10) Patent No.: US 6,572,443 B1
(45) Date of Patent: Jun. 3, 2003

(54) METHOD AND APPARATUS FOR DETECTING A PROCESS ENDPOINT

(75) Inventors: Peter J. Beckage, Austin, TX (US); Keith A. Edwards, Austin, TX (US); Ralf B. Lukner, Austin, TX (US); Wonhui Cho, Cedar Park, TX (US)

(73) Assignee: Advanced Micro Devices Inc., Austin, TX (US)

( * ) Notice: Subject to any disclaimer, the term of this patent is extended or adjusted under 35 U.S.C. 154(b) by 315 days.

(21) Appl. No.: 09/633,596

(22) Filed: Aug. 7, 2000

Related U.S. Application Data

(63) Continuation of application No. 09/271,072, filed on Mar. 17, 1999, now Pat. No. 6,179,688.

(51) Int. Cl.[7] ..... B24B 49/00

(52) U.S. Cl. ..... 451/6; 451/6; 451/7; 451/10; 451/41; 451/53; 451/288

(58) Field of Search ..... 451/6, 7, 10, 41, 451/53, 288

(56) References Cited

U.S. PATENT DOCUMENTS

| | | | | |
|---|---|---|---|---|
| 5,240,552 | A | 8/1993 | Yu et al. | 156/636 |
| 5,245,794 | A | 9/1993 | Salugsugan | 51/165.74 |
| 5,337,015 | A | 8/1994 | Lustig et al. | 324/671 |
| 5,413,941 | A | 5/1995 | Koos et al. | 437/8 |
| 5,433,651 | A | 7/1995 | Lustig et al. | 451/5 |
| 5,499,733 | A | 3/1996 | Litvak | 216/38 |
| 5,644,221 | A | 7/1997 | Li et al. | 324/71.5 |
| 5,658,183 | A | 8/1997 | Sandhu et al. | 451/5 |
| 5,659,492 | A | 8/1997 | Li et al. | 364/569 |
| 5,663,797 | A | 9/1997 | Sandhu | 438/16 |
| 5,708,506 | A | 1/1998 | Birang | 356/371 |
| 5,846,882 | A | 12/1998 | Birang | 438/692 |
| 5,865,665 | A | 2/1999 | Yueh | 451/5 |
| 5,868,896 | A | 2/1999 | Robinson et al. | 156/344 |
| 6,179,688 | B1 * | 1/2001 | Beckage et al. | 451/10 |

FOREIGN PATENT DOCUMENTS

| | | |
|---|---|---|
| EP | 0616362 | 9/1994 |
| EP | 0738561 | 10/1996 |
| WO | WO 98/55264 | 12/1998 |

OTHER PUBLICATIONS

International Search Report mailed Apr. 5, 2000 (PCT/US99/27209; TT3028–PCT).

* cited by examiner

*Primary Examiner*—William Hong
(74) *Attorney, Agent, or Firm*—Williams, Morgan & Amerson, P.C.

(57) ABSTRACT

An apparatus and method for detecting a process endpoint. The method includes receiving a first data signal and a second data signal and combining the first data signal and the second data signal to generate a combined data signal. The method also includes detecting a peak in the combined data signal, wherein the peak indicates the process endpoint. The apparatus includes a data collection unit capable of receiving a plurality of data signals and a signal analysis unit. The signal analysis unit is capable of combining the plurality of data signals received through the data collection unit to generate a combined data signal and identifying a peak in the combined data signal indicative of the process endpoint.

43 Claims, 8 Drawing Sheets

METHOD AND APPARATUS FOR DETECTING A PROCESS ENDPOINT

This is a continuation of Ser. No. 09/271,072, filed Mar. 17, 1999, now U.S. Pat. No. 6,179,688.

BACKGROUND OF THE INVENTION

1. Field of the Invention

This invention generally pertains to semiconductor processing, and, more particularly, to the polishing of process layers formed above a semiconducting substrate.

2. Description of the Related Art

The manufacture of semiconductor devices generally involves the formation of various process layers, selective removal or patterning of portions of those layers, and deposition of yet additional process layers above the surface of a semiconducting substrate. The substrate and the deposited layers are collectively called a "wafer." This process continues until a semiconductor device is completely constructed. The process layers may include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers.

FIGS. 1A and 1B illustrate a general process for providing such a planar uppermost surface. FIG. 1A illustrates a portion of a wafer 10 during the manufacture of a semiconducting device. A layer of insulative material is deposited on the wafer 10 over the substrate 11 and partially etched away to create the insulators 12. A layer of conductive material 14, e.g., a metal, is then deposited over the wafer 10 to cover the insulators 12 and the substrate 11. The layer of conductive material 14 is then "planarized." FIG. 1B illustrates the wafer 10 after the layer of conductive material 14 is planarized to create the interconnects 16 between the insulators 12.

One process used to planarize process layers is known as "chemical-mechanical polishing," or "CMP." In a CMP process, a deposited material, such as the conductive material 14 in FIG. 1A, is polished to planarize the wafer for subsequent procession steps. Both insulative and conductive layers may be polished, depending on the particular step in the manufacture.

In the case of metal CMP, a metal previously deposited on the wafer is polished with a CMP tool to remove a portion of the metal to form insulator interconnects such as lines and plugs, e.g., the interconnects 12 in FIG. 1B. The metal process layer is removed by an abrasive action created by a chemically active slurry and a polishing pad. A typical objective is to remove the metal process layer down to the upper level of the insulative layer, as was the case for the example of FIGS. 1A and 1B.

Such a CMP process is more particularly illustrated in FIGS. 2A and 2B. A wafer is typically mounted upside down on a carrier 22. A force (F) pushes the carrier 22 and the wafer 20 downward. The carrier 22 and the wafer 20 are rotated above a rotating pad 24 on the CMP tool's polishing table 26. A slurry (not shown) is generally introduced between the rotating wafer 20 and the rotating pad 24 during the polishing process. The slurry may contain a chemical that dissolves the uppermost process layer(s) and/or an abrasive material that physically removes portions of the layer(s). The wafer 20 and the pad 24 may be rotated in the same direction or in opposite directions, whichever is desirable for the particular process being implemented. In the example of FIGS. 2A and 2B, the wafer 20 and the pad 24 are rotated in the same direction as indicated by the arrows 28. The carrier 22 may also oscillate across the pad 24 on the polishing table 26, as indicated by the arrow 29.

The point at which the excess conductive material is removed and the embedded interconnects remain is called the "endpoint" of the CMP process. The CMP process should result in a planar surface with little or no detectable scratches or excess material present on the surface. In practice, the wafer, including the deposited, planarized process layers, are polished beyond the endpoint to ensure that all excess conductive material has been removed. Polishing too far beyond the endpoint increases the chances of damaging the wafer surface, uses more of the consumable slurry and pad than may be necessary, and reduces the production rate of the CMP equipment. The window for the polish time endpoint can be small, e.g., on the order of seconds. Also, variations in material thickness may cause the endpoint to change. Thus, accurate in-situ endpoint detection is highly desirable.

Current techniques for endpoint detection may be classed as optical reflection, thermal detection, and friction based techniques. Optical reflection techniques encounter higher levels of signal noise as the number of process layers increase, thereby decreasing the accuracy of endpoint detection outside the range where the endpoint can be detected. Optical reflection techniques may also require that the wafer be moved off the edge of the polishing table. This frequently interrupts the polishing process. This may also cause the endpoint to be missed and its detection delayed by perhaps as much as a few seconds, depending on oscillation speed and distance. Thermal techniques suffer from thermal noise caused by variations in the wafer production rate, variations in the slurry, or changes in the pad. Thermal techniques are also adversely impacted by complexity in the thermal variations as the CMP tool warms and cools over the operation cycle and carrier arm oscillations.

Friction-based techniques detect the endpoint by monitoring the power consumed by the CMP tool's carrier motor(s) and detect the endpoint from the changes therein. The electrical current required to rotate the carrier at a given, specified speed is directly affected by the drag of the wafer on the pad. The coefficient of friction is different for a metal sliding on the pad versus an insulating oxide on the pad, and this difference appears as a change in the carrier motor current, and hence the carrier motor power consumption. The carrier motor current is monitored using Hall effect probes or mechanically clamping sensors. Friction-based techniques detect the endpoint from the change in the current or from the slope of the current profile.

Friction-based techniques also have their drawbacks. The power signals from which the endpoint is detected in a friction-based technique are highly susceptible to noise. Noise may be induced by electromagnetic fields emanating from nearby equipment. Also, where the carrier radially oscillates, the rotation of the carrier(s) and the table introduce noise. This noise must be filtered from the power signal. Even with filtering, however, the power signals may have complex shapes that mask the relatively simple change in the current or power caused when the endpoint is reached. When the carrier current profile is complicated, techniques based on a change in the current or slope of the current profile frequently fail due to variations in the profile from run to run or the large amount of noise inherent in the polishing process.

The present invention is directed to a semiconductor processing method and apparatus that addresses some or all of the aforementioned problems.

SUMMARY OF THE INVENTION

In one aspect of the present invention, a method for detecting a process endpoint is presented. The method includes receiving a first data signal and a second data signal and combining the first data signal and the second data signal to generate a combined data signal. The method also includes detecting a peak in the combined data signal, wherein the peak indicates the process endpoint. In various embodiments, receiving the first data signal and the second data signal includes receiving at least one of a carrier motor current signal, a table motor current signal, a polishing table temperature signal, a pad temperature signal, a reflected white-light optical signal, and a reflected fixed wavelength optical signal. In various embodiments, combining the first data signal and the second data signal includes at least one of filtering noise from at least one of the first and second data signals, weighting at least one of the first and second data signals, adding the first and second data signals, or multiplying the first and second data signals.

In another aspect of the present invention, an apparatus for detecting a process endpoint is presented. The apparatus includes a data collection unit capable of receiving a plurality of data signals and a signal analysis unit. The signal analysis unit is capable of combining the plurality of data signals received through the data collection unit to generate a combined data signal and identifying a peak in the combined data signal indicative of the process endpoint. In one embodiment, the apparatus also includes a computer programmed to combine the plurality of data signals to generate the combined data signal and identify the peak in the combined data signal indicative of the process endpoint.

In yet another aspect of the present invention, a computer-readable, program storage device encoded with instructions that, when executed by a computer, performs a method for detecting a process endpoint is provided. The method includes combining a first data signal from a first sensor and a second data signal from a second sensor different from the first sensor to generate a combined data signal and detecting a peak in the combined data signal. The first data signal and the second data signal are different, and the peak indicates the process endpoint.

In still yet another aspect of the present invention, another method for detecting a process endpoint is provided. This method includes receiving a data signal and detecting a peak indicative of the process endpoint in the received data signal. The peak detection includes determining a high value for an initial peak and determining a low value for a following trough. The peak detection also includes estimating a value for the endpoint process from the high value and the low value and identifying subsequent peaks in the received data signal. The peak detection also includes filtering out a subsequent peak less than the estimated value and identifying a remaining subsequent peak as the process endpoint.

In still another aspect of the present invention, another apparatus for detecting a process endpoint is provided. This apparatus includes a data collection unit and a signal analysis unit. The data collection unit is capable of receiving one or more data signals. The signal analysis unit is capable of identifying a peak in the one or more data signals indicative of the process endpoint. Identifying the peak includes combining the one or more data signals to form a combined data signal and determining a high value for an initial peak. Identifying the peak also includes determining a low value for a following trough and estimating a value for the endpoint process from the high value and the low value. Identifying the peak also includes identifying subsequent peaks in the combined data signal, filtering out a subsequent peak less than the estimated value, and identifying a remaining subsequent peak as the process endpoint.

BRIEF DESCRIPTION OF THE DRAWINGS

The invention may be understood by reference to the following description taken in conjunction with the accompanying drawings, in which like reference numerals identify like elements, and in which:

FIGS. 3–4 illustrate a first aspect of the invention, wherein:

- FIG. 3 depicts one embodiment of a method practiced in accordance with a first aspect of the present invention; and
- FIG. 4 depicts, in a conceptualized block diagram, an apparatus such as may be employed in accordance with the first aspect of the invention;

FIGS. 5–8 illustrate a second aspect of the invention, wherein:

- FIG. 5 illustrates one embodiment of a method practiced in accordance with the second aspect of the invention;
- FIG. 6 depicts an unfiltered data signal generated by a CMP tool during a CMP process;
- FIG. 7 depicts a filtered data signal generated by processing the unfiltered data signal of FIG. 6; and
- FIG. 8 illustrates one particular embodiment of an apparatus with which the method of FIG. 5 may be employed in accordance with the second aspect of the invention;

FIGS. 9–12 illustrate one particular embodiment of the present invention incorporating both the first aspect illustrated in FIGS. 3–4 and the second aspect illustrated in FIGS. 5–8, wherein:

- FIG. 9 depicts, in a conceptualized block diagram, an apparatus for such an embodiment;
- FIG. 10 depicts a method implemented in such an embodiment;
- FIG. 11 depicts how one particular step in the method of FIG. 10 may be performed;
- FIG. 12 graphs four separate data signals employed by the embodiment illustrated in FIGS. 9–10.

Figure 1A:
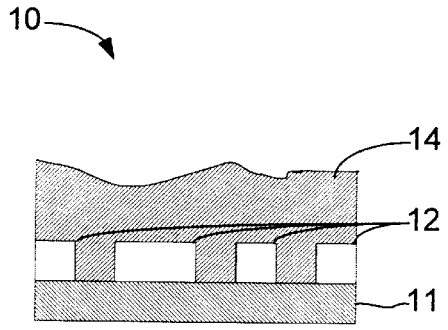
Fig. 1A (Prior Art)
FIGS. 1A and 1B illustrate the planarization of a wafer during manufacture in accord with conventional practice.
Figure 1B:
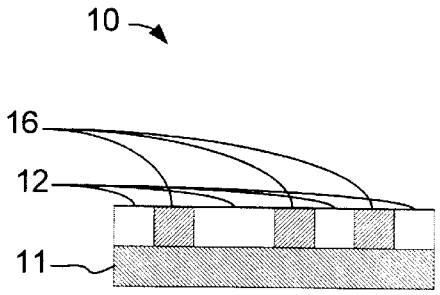
Fig. 1B (Prior Art)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specifications It will be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort, even if complex and time-consuming, would be a routine undertaking for those of ordinary skill in the art having the benefit of this disclosure.

Figure 3:
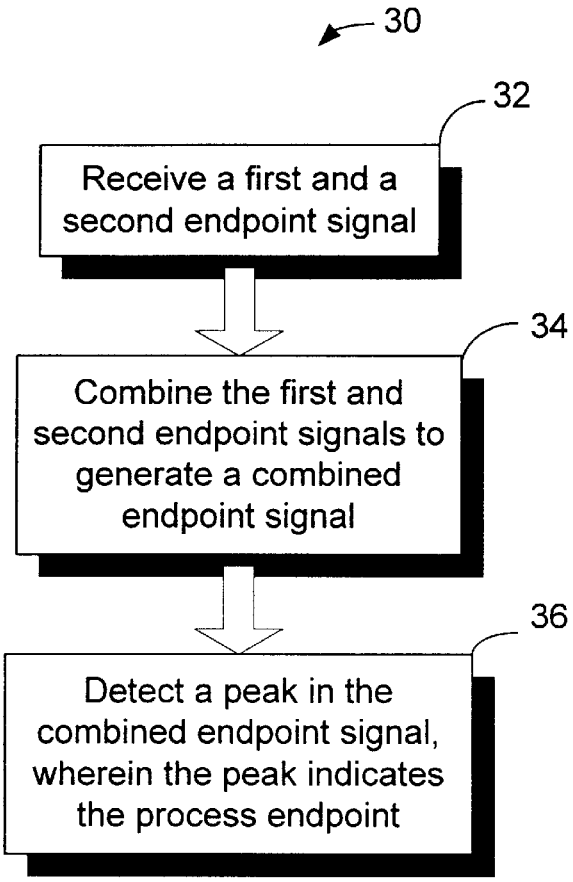
Figure 4:
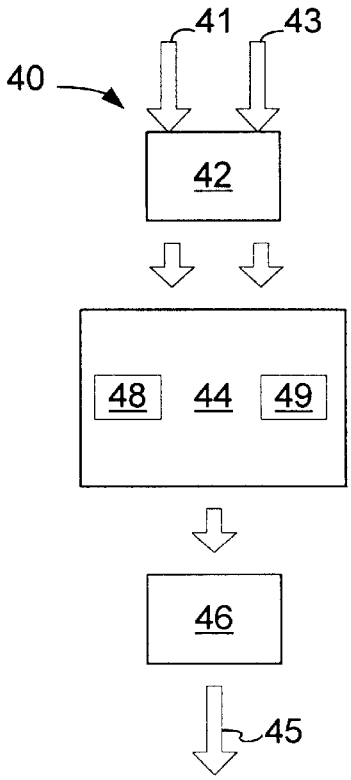

A First Aspect of the Invention-A Method and Apparatus for Determining the Endpoint of a CMP Process In a first aspect, the invention is a method and apparatus for determining the endpoint of a CMP process by combining a plurality of data signals. This aspect of the invention is illustrated in FIGS. 3–4. FIGS. 3–4 illustrate a method 30 and an apparatus 40 performed, constructed, and operated in accordance with this first aspect. In the embodiment illustrated in FIGS. 3–4, the apparatus 40 is operated in a manner implementing the method 30. However, this is not necessary to the practice of the invention. The method 30 may be performed using an alternative apparatus and the apparatus 40 may be employed in a manner contrary to the method 30 in alternative embodiments. Nevertheless, for the sake of clarity, this first aspect of the invention shall be discussed in the context of the method 30 implemented using the apparatus 40.

The method 30 in the particular embodiment of FIG. 3 comprises at least three steps. First, as set forth in the box 32, a first and a second data signal 32 are received. A "data signal," as the term is used herein, shall be any signal from which the endpoint of a CMP process can be detected. Exemplary data signals include the carrier motor current signal, the table motor current signal, the polishing table temperature signal, the pad temperature signal, a reflected white-light optical signal, and a reflected fixed wavelength optical signal. Conventional CMP tools generate these and other data signals using techniques well known to the art. Second, as set forth in the box 34, the first and second data signals are combined to generate a combined data signal. Third, a peak indicative of the process endpoint is detected in the combined data signal as is indicated in the box 36.

Turning to FIG. 4, the apparatus 40, in this particular embodiment, comprises a data a data collection unit 42, a signal analysis unit 44, and a signal generating unit 46. The data collection unit 42 is capable of receiving a plurality of data signals. The particular embodiment of the apparatus 40 illustrated in FIG. 4 receives only two data signals 41 and 43, but the invention is not so limited. The data collection unit 42 transmits the received data signals to the signal analysis unit 44. The signal analysis unit 44 is capable of combining the received data signals 41 and 43 to generate a combined data signal (not shown) and identifying a peak in the combined data signal indicative of the process endpoint. To this end, the particular embodiment of the signal analysis unit 44 illustrated in FIG. 4 includes a signal combiner 48 and a peak identifier 49. The signal generating unit 46 is capable of generating a signal 45 indicating that the process endpoint has been detected.

Referring now to both FIGS. 3 and 4, the method 30 begins, as set forth in the block 32, with the apparatus 40 receiving a first data signal 41 and a second data signal 43 at the data collection unit 42 thereof The apparatus 40 of FIG. 4 is shown receiving two data signals 41 and 43 although, as mentioned above, other embodiments may use more. It is generally preferable to use more, rather than fewer data, signals to increase the robustness of the endpoint detection. In one particular embodiment discussed more fully below, as many as five data signals are employed.

The data signals 41 and 43 are received by the data collection unit 42 in parallel and, in the particular embodiment illustrated, are then transmitted to the signal analysis unit 44 in parallel. Again, however, the invention is not so limited. For instance, the data signals 41 and 43 may be multiplexed and demultiplexed in alternative embodiments so that they may be received and/or transmitted by the data collection unit 42 in series.

The method 30 in FIG. 3 then proceeds, as set forth in the box 34, by combining the first and second data signals 41 and 43 to generate a combined data signal (not shown). The signal analysis unit 44 of the apparatus 40 includes a signal combiner 48 that combines the data signals 41 and 43. In various embodiments, the data signals 41 and 43 may be combined by adding them, multiplying them, or some other suitable technique as may become apparent to those skilled in the art having the benefit of this disclosure. Some embodiments may also weight the data signals 41 and 43. Exemplary techniques for combining the data signals 41 and 43 are discussed further below in connection with the particular embodiment of FIGS. 9–13. Note, also, that the data signals 41 and 43 may, in some alternative embodiments, be conditioned or otherwise processed to facilitate their combination and/or the peak detection. For instance, one or more of the data signals 41 and 43 may be filtered in accordance with a second aspect of the invention discussed more fully below in association with FIGS. 8–10.

As set forth in the third box 36 of FIG. 3, the method 30 concludes with the detection of a peak in the combined data signal indicative of the process endpoint. The signal analysis unit 44 includes a peak identifier 49 for this purpose. Data signals contain a characteristic peak indicative of the process endpoint. This peak may be detected in any manner known to the art for detecting such peaks in single data signals such as the data signals 41 and 43. The present invention differs, however, from the art in that these techniques are applied to a combined data signal as opposed to a single data signal such as the data signals 41 and 43. By combining two or more data signals, such as the data signals 41 and 43, the peak detection in the present invention provides a much more robust determination of the process endpoint.

The apparatus 40 of FIG. 4, like the method 30 of FIG. 3, is capable of great variation within the scope and spirit of the invention. For instance, the apparatus 40 may be implemented in hardware, software, or some combination of the two. Where the apparatus 40 is implemented at least in part in software, the apparatus 40 comprises a suitably programmed computer, wherein one or more functions, e.g., the signal combination and the peak detection, are performed by the computer in accordance with a plurality of instructions encoded on a computer-readable program storage device. Exemplary program storage devices include, but are not limited to, an optical disk, a floppy disk, a hard drive, and a memory device.

As mentioned, peak detection in box 36 may employ any suitable technique known to the art. One particular embodiment, discussed further below, fits a parabola to the curve and then performs a least squares fit to identify peaks in the signal. Other embodiments might detect peaks from derivative or double derivative of the curve represented by the filtered signal 70. Also, there are several commerically available software packages well known to the art after peak detection of this sort.

Figure 2A:
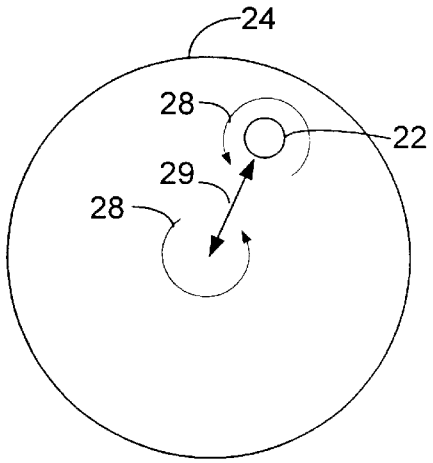
Fig. 2A (Prior Art)
FIGS. 2A and 2B illustrate the operation of a CMP tool during a conventional CMP process.
Figure 2B:
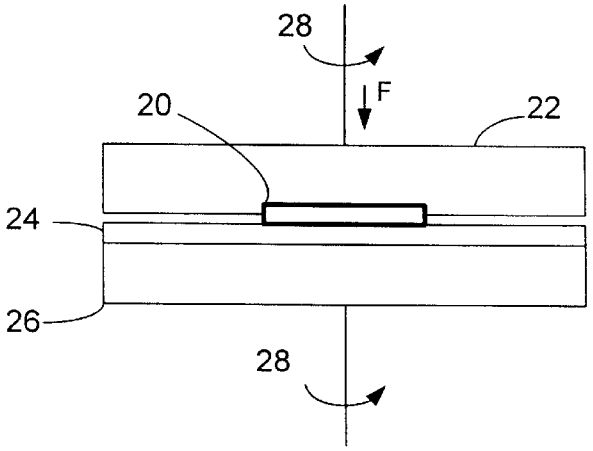
Fig. 2B (Prior Art)
Figure 5:
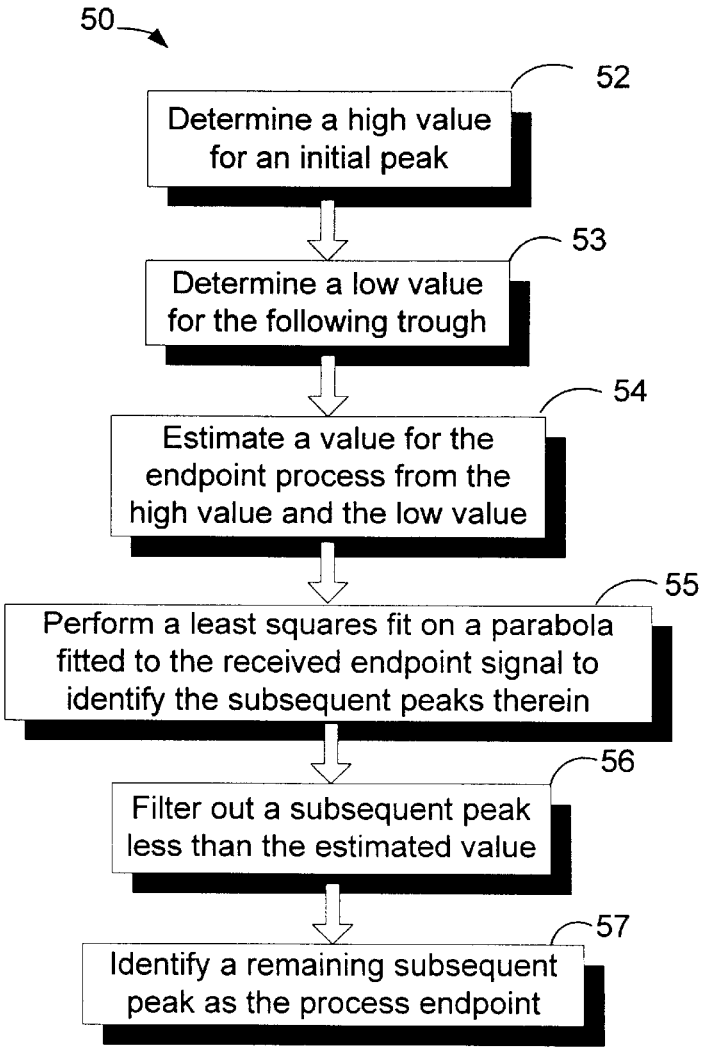
Figure 6:
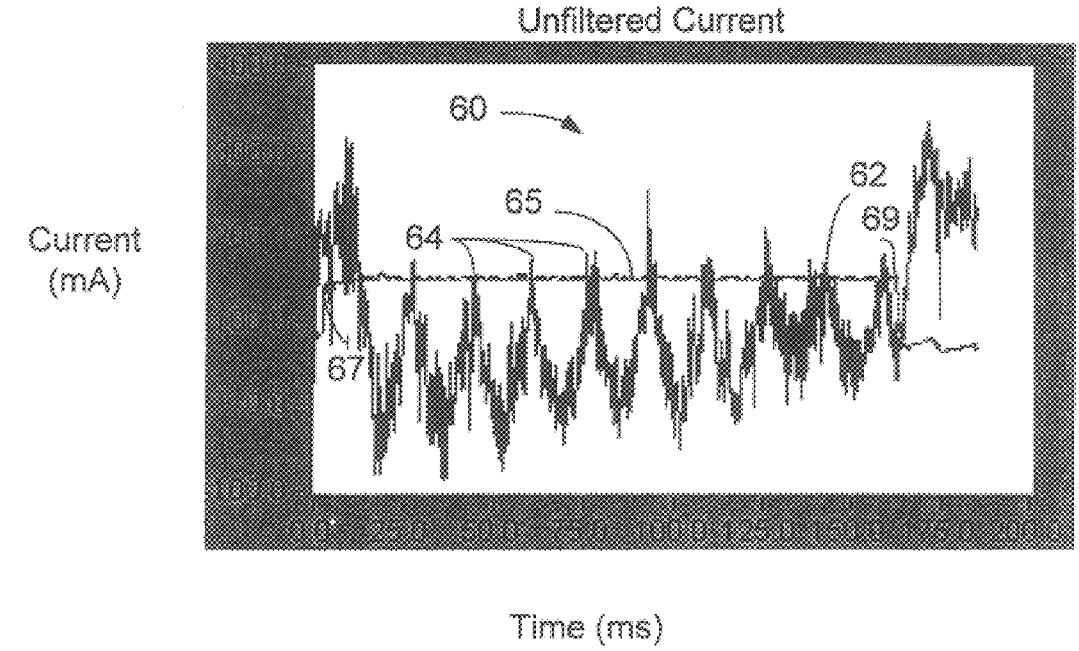
Figure 7:
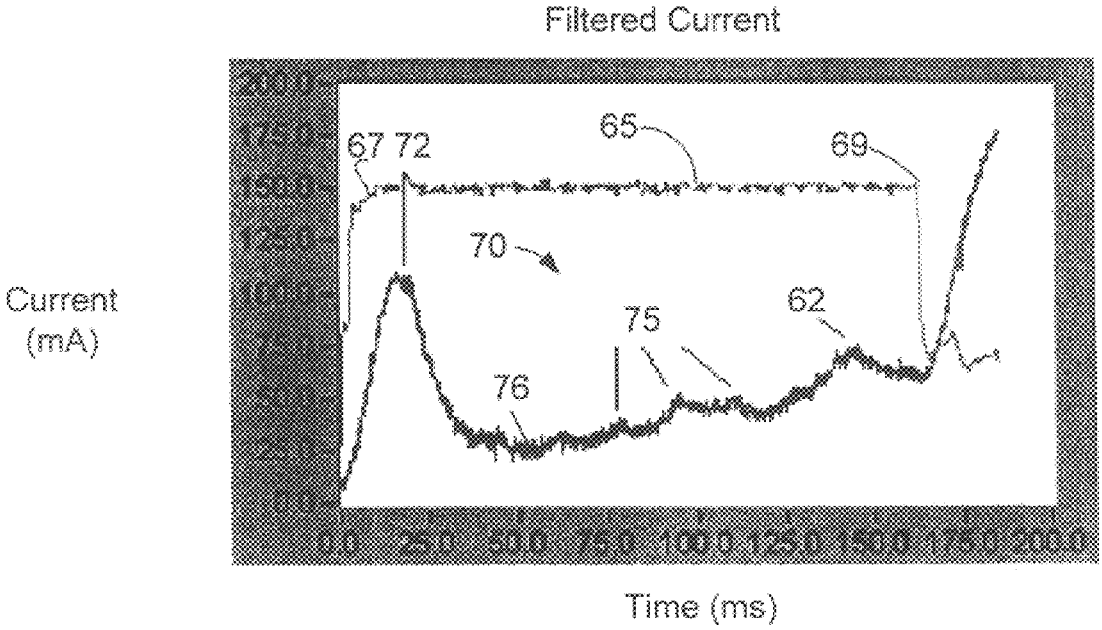

A Second Aspect of the Invention-A Method for Determining the Endpoint of a CMP Process from a Single Data Signal A second aspect of the invention is illustrated in FIGS. 5–8. In this second aspect, noise is filtered from one or more of the data signals using the method 50 of FIG. 5. FIG. 6 depicts an exemplary unfiltered signal 60 representative of a current, such as the table motor current or the carrier motor current. FIG. 7 depicts a filtered signal 70 produced filtering the signal 60 of FIG. 6 to remove noise. Both the signal 60 of FIG. 6 and the signal 70 of FIG. 7 are graphed as a function of time over the course of a CMP process. Each of FIGS. 6–7 also depicts a signal 65. The signal 65 indicates the amount of downward force (F in FIG. 2B) applying the wafer against the polishing pad.

Referring now specifically to FIG. 6, the process endpoint occurs at the peak 62 in the signal 60. Many of the peaks, such as the peaks 64, are the product of signal noise introduced as earlier discussed. The noise can obscure and exacerbate difficulties in identifying the process endpoint from the peak 62. In the unfiltered signal 60, the peak 62 is partially produced by signal noise that obscures the peak actually produced by the process endpoint. As can be seen in FIG. 6, the noise in this particular embodiment so obscures the peak 62 at which the endpoint occurs that it is questionable whether the endpoint can be accurately detected therefrom. It is therefore desirable to filter the noise from the signal 60 and a lowpass filter is applied for the purpose. Note, however, that other types of filters, e.g., a bandpass filter, might be employed in alternative embodiments. Applying a lowpass filter yields the filtered signal 70 in FIG. 7.

Referring now to FIG. 7, the progress of the CMP process can be determined from the signal 65. The polishing begins at point 67, where the downward force causes the wafer to contact the polishing pad. Contacting the wafer with the pad spikes the current signal 70, which results in an initial peak 72. As the contact is maintained, the current signal 70 enters a trough having a low point 76. The process endpoint is indicated by the peak 62 in the signal 60. Polishing continues for some predetermined period of time after the process endpoint 62 is reached. At the point 69, the downward force is removed and the wafer is lifted from the polishing pad.

However, even after filtering, the signal 70 in FIG. 7, e.g., still retains many spurious, or false, peaks. These spurious peaks are not indicative of the endpoint, e.g., the initial peak 72 and the peaks 75. The method 50 of FIG. 5 may be used to identify the peak indicative of the process endpoint from among the spurious peaks.

The method 50 in FIG. 5 assumes that a data signal has been received. Once the signal is received, the method 50 begins by determining a high value of an initial peak, e.g., initial peak 72 in FIG. 7, and a low value in the following trough, e.g., the trough 76 in FIG. 7, as is set forth in the boxes 52, 53. This initial peak/following trough is characteristic in motor current signals associated with CMP processes. Thus, it is anticipated that the method of FIG. 5 will be applicable with virtually all motor current signals generated by CMP tools.

Returning to FIG. 5, the method 50 then proceeds by estimating a value for the process endpoint, e.g., the endpoint 62 in FIG. 7, as set forth in the box 54. The difference between the two values is first calculated. The estimated value for the endpoint is then taken as an adjustable percentage of the difference between the high and low values. The adjustable percentage is set by a parameter whose value will vary depending on the particular polishing process underway and may be determined through observation or trial and error. For example, suppose the high value is 110 and the low value is 20, and the adjustment parameter is 60%. The estimated endpoint then would be 0.6(110-20)+20=74.

The method 50 then proceeds, as set forth in the box 55 of FIG. 5, to perform a least squares fit on a parabola fitted to the received data signal to identify the subsequent peaks therein. This step identifies all subsequent peaks, e.g., the peaks 75 and the peak 62 in FIG. 7, in the received data signal. In one particular embodiment, subsequent peaks are identified sequentially in time. As each subsequent peak is identified, it is measured against the estimated value. If does not match or exceed the estimated value, then it is ignored. Thus, the estimated value is employed as a threshold which any given subsequent peak must match or exceed or else the subsequent peak is filtered out of the analysis as set forth in the box 56 in FIG. 5.

The method 50 concludes by identifying a remaining subsequent peak as the process endpoint as set forth in the box 57. In the particular embodiment mentioned immediately above, the first subsequent peak matching or exceeding the estimated value is identified as the process endpoint, e.g., peak 62 in FIG. 7. A signal is then typically generated to indicate that the process endpoint has been reached.

Because a least squares fit is employed in the particular embodiment illustrated in FIG. 5, not all data signals may be used in this particular embodiment. For instance, optical sensors commonly generate a data signal that is not a continuous curve. A least square fit would therefore not return a valid result on such a signal. However, any data signal comprising a continuous curve is suitable. Data signals exemplifying this characteristic include, but are not limited to, the table current and the carrier current. Other embodiments employing techniques other than a least squares fit might not suffer from this limitation.

As noted above, the method 50 may be employed to filter more than one data signal, but this aspect of the invention is not so limited. This aspect of the invention may be implemented in an embodiment in which only a single, unfiltered, data signal is received. One such embodiment is illustrated in FIG. 8.

Figure 8:
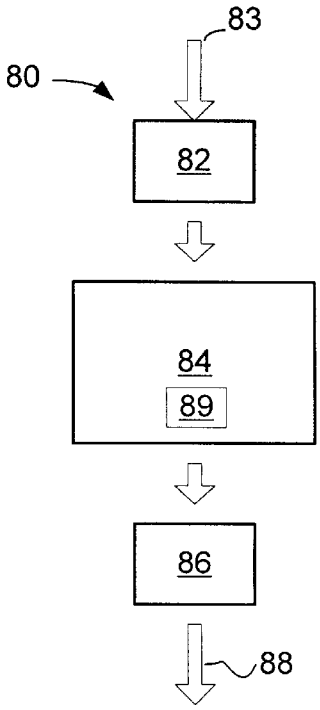

FIG. 8 depicts, in a functional block diagram, an apparatus 80. The apparatus 80 generally comprises a data collection unit 82, a signal analysis unit 84, and a signal generating unit 86. The apparatus 80 may be constructed and operated like the apparatus 40 of FIG. 4 except it receives only the single data signal 83, omits a signal combiner, and the peak identifier 89 implements the method 50 of FIG. 5. Note that alternative embodiments may receive multiple data signals like the apparatus 40 of FIG. 4. Note also that some embodiments of the apparatus 40 in FIG. 4 may employ the method 50 of FIG. 5 in the peak identifier 49 to identify the process endpoint.

Figure 9:
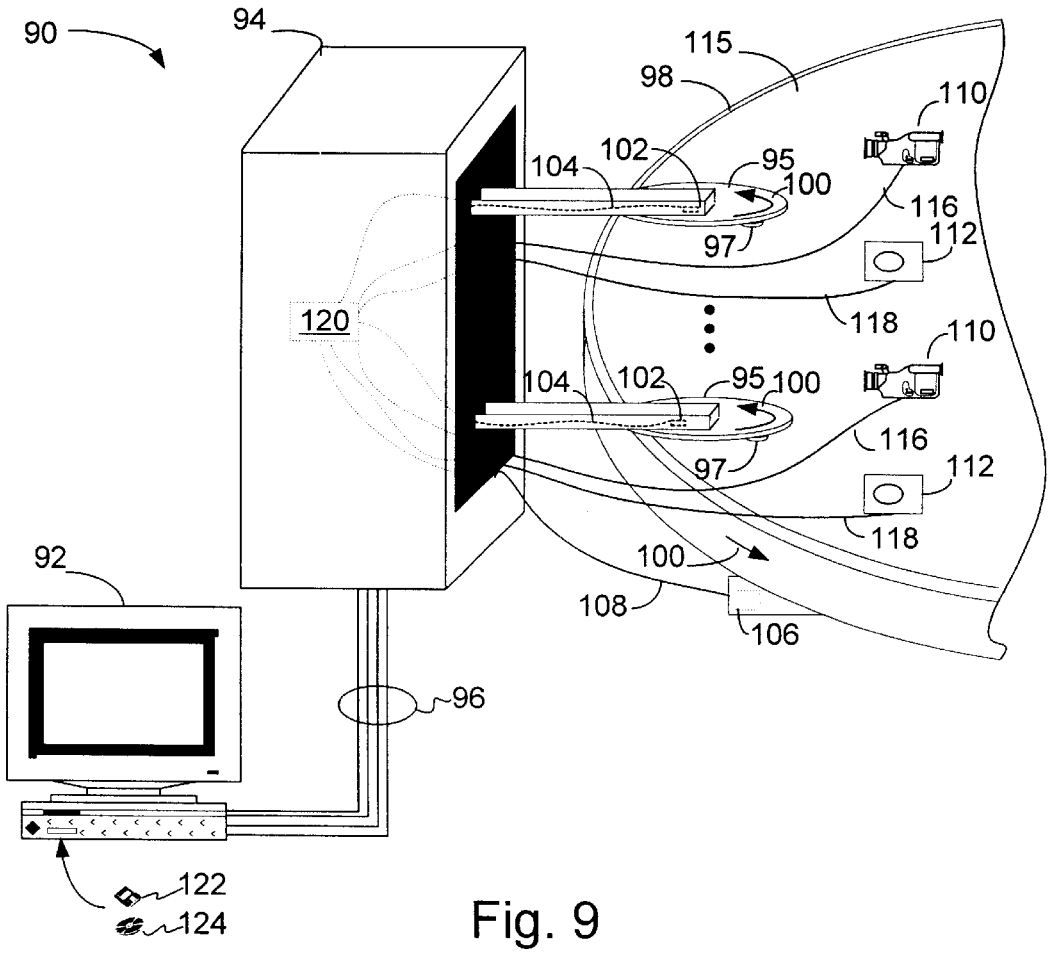
Figure 10:
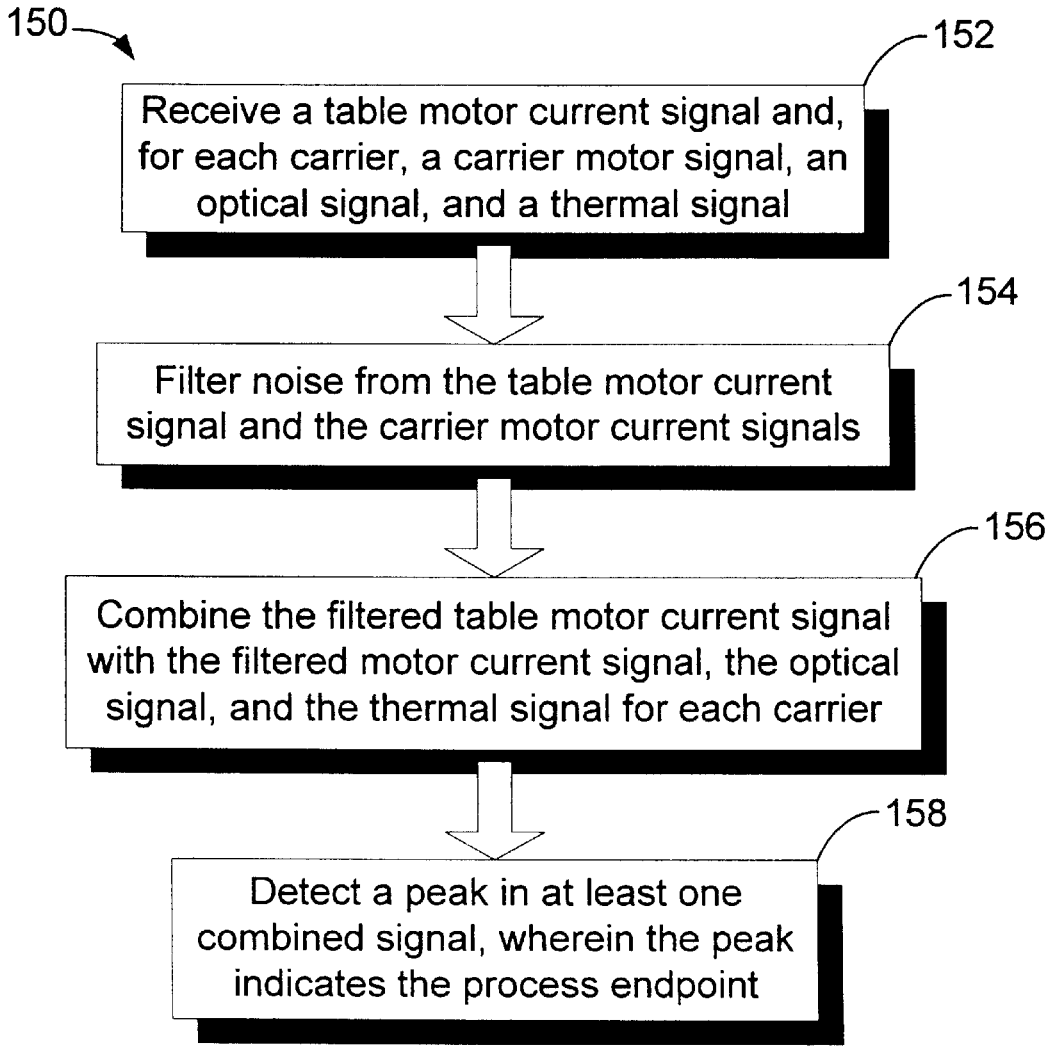
Figure 11:
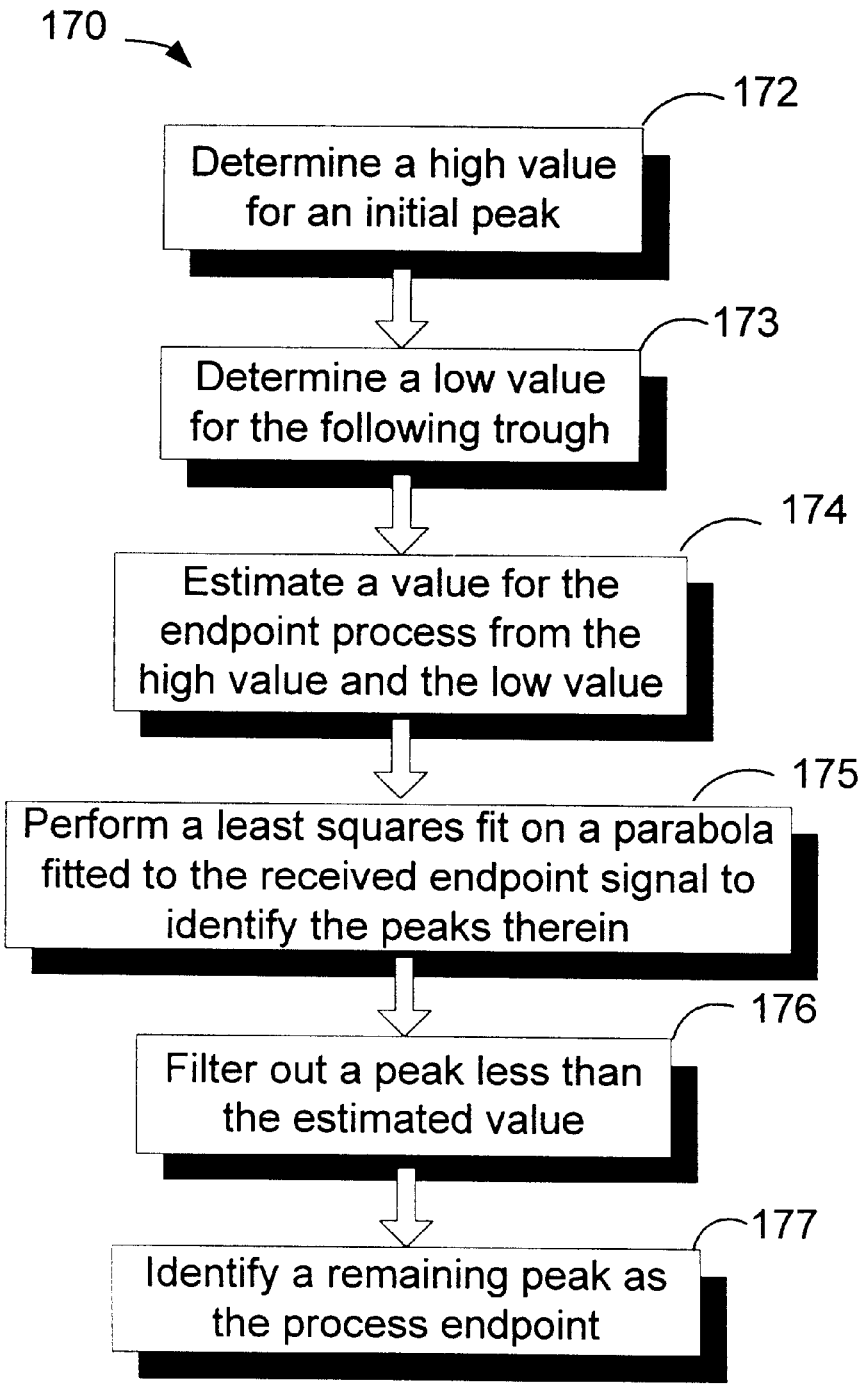
Figure 12:
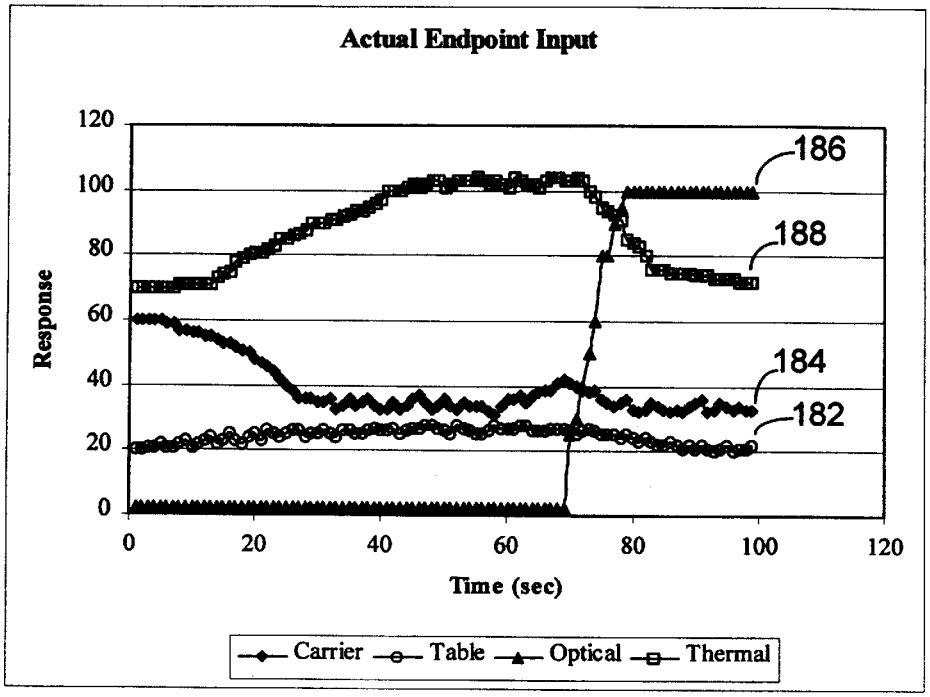
Figure 13:
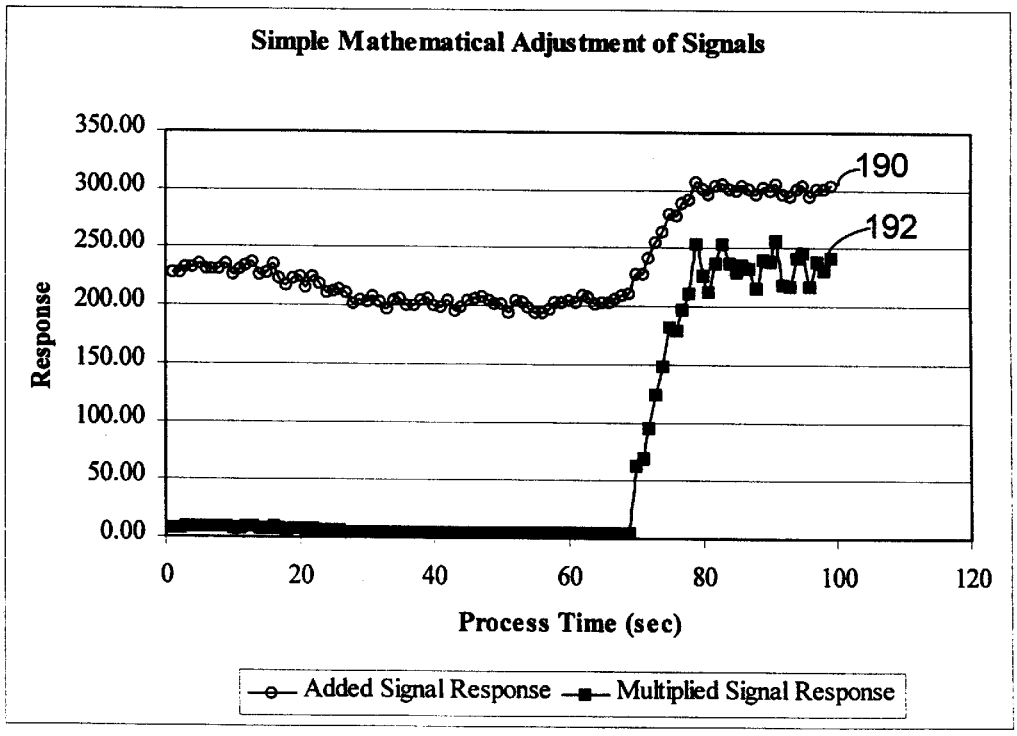
- FIG. 13 graphs two separate combined data signals as may be generated by the method and apparatus of FIGS. 9–10 from the data signals graphed in FIG. 11.

A Particular Embodiment of the Invention Including Both the First and Second Aspects of the Invention FIGS. 9–12 illustrate one particular embodiment of the invention, including both aspects thereof. More particularly, FIG. 9 depicts a conceptualization of an apparatus 90 including a computer 92 programmed to perform the method of FIGS. 10–11. FIG. 12 depicts four exemplary data signals 182, 184, 186, and 188 utilized by the particular embodiment to detect the endpoint process. FIG. 13 depicts two combined data signals 190 and 192 that the apparatus 90 may generate from the four data signals 182, 184, 186, and 188 displayed in FIG. 12.

More particularly, the apparatus 90 comprises a programmable computer 92 exchanging signals with a CMP tool 94 over a bus system 96. The programmable computer 92 may be any computer suitable to the task and may include, without limitation, a personal computer (desktop or laptop), a workstation, a network server, or a mainframe computer. The computer 92 may operate under any suitable operating system, such as Windows®, MS-DOS, OS/2, UNIX, or Mac OS. The bus system 96 may operate pursuant to any suitable or convenient bus or network protocol. Exemplary network protocols include Ethernet, RAMBUS, Firewire, token ring, and straight bus protocols. Some embodiments may also employ one or more serial interfaces, e.g., 125232, SEGS, GEM. Similarly, the CMP tool 94 may be any CMP tool known to the art.

As will be recognized by those in the art having the benefit of this disclosure, the appropriate types of computer, bus system, and CMP tool will depend on the particular implementation and concomitant design constraints, such as cost and availability. In one particular embodiment, the computer 92 is an IBM compatible, desktop personal computer operating on a Windows® operating system; the CMP tool 94 is manufactured by Speedfam Corporation; and the bus system 96 is an Ethernet network. These selections resulted in an apparatus 90 that implements the present invention in both hardware and software. However, other embodiments may employ hardware or software only.

The CMP tool 94 in the particular embodiment employs five carriers 95, only two of which are shown for the sake of clarity, and each carrier 95 is capable of polishing a wafer 97 on the polishing table 98. Each of the carriers 95 and the polishing table 98 rotate counter-clockwise as illustrated by the arrows 100. Each of the carriers 95 is driven by a carrier motor (not shown) whose current is sensed by a current sensor 102 that transmits a data signal via a lead 104. A table motor (not shown) drives the polishing table 98. The current to the table motor is sensed by a current sensor 106 that transmits a corresponding data signal via a lead 108.

The polishing process of each of the carriers 95 is sensed by several types of sensors. The apparatus 90 employs a thermal camera 110 and an optical sensor 112 for each carrier 95. The thermal cameras 110 may sense the temperature of either the polishing pad 115 or the polishing table 98. The optical sensors 112 may employ either a white-light optical signal or a fixed wavelength optical signal. The thermal cameras 110 and the optical sensors 112 transmit data signals via leads 116 and 118, respectively.

The CMP tool 94 also includes a data collection and processing unit 120. The data collection and processing unit 120 receives data signals via the leads 116 and 118. More particularly, the data collection and processing unit 120 receives the following data signals:

- a table motor current data signal via the lead 108;
- a carrier motor current data signal from each carrier 95 via the leads 104;
- a thermal data signal associated with each carrier 95 from a respective thermal camera 110 via the leads 116;
- an optical data signal associated with each carrier 95 from a respective optical sensor 112 via the leads 118;

Note that alternative embodiments of the apparatus 90 might employ only a single optical sensor 112 or a single thermal camera 110.

The data collection and processing unit 120 receives each of the data signals simultaneously and in parallel. The unit 120 then transmits the table motor current data signal; the carrier motor data signals; the optical data signals; and the thermal data signals to the computer 92 over the bus system 96. In this particular embodiment, these data signals are unfiltered when transmitted. Alternative embodiments might, however, filter the signals after collection and before transmitting them to the computer 92.

As earlier mentioned, the bus system 96 for this particular embodiment is an Ethernet network and operates in full accord with the Ethernet protocol. The design, installation, and operation of Ethernet networks are well known in the art. The data collection and processing unit 120 transmits the data signals listed above to the computer 92 in accordance with the Ethernet protocol. The particular CMP tool 94 employed in this embodiment is equipped with a network port through which the computer 92 interfaces with the unit 120 over the bus system 96.

The computer 92 is programmed to execute an applications software package whose instructions are encoded on a computer-readable program storage device, such as the floppy disk 122 or the optical disk 124. The instructions may be included on any program storage device the computer 92 is capable of reading, including the computer 92's hard disk (not shown). More particularly, the computer 92 is programmed to implement the method of FIG. 5. Although not previously applied in the context of CMP processing, commercial, off-the-shelf software packages are available that may be configured to perform this method. One such package is the LabVIEW™ (Version 5.0) software applications available from National Instruments Corporation, located at 11500 N Mopac Expressway, Austin, Tex. 78759-3504, and who may be contacted by telephone at (512) 794-0100.

FIG. 10 illustrates a method 150 including both aspects of the invention discussed above. The method 150 begins by, as set forth in the box 152, receiving a table motor current signal and, for each carrier, a carrier motor signal, an optical signal, and a thermal signal. Next, as set forth in box 154, the noise is filtered from the table motor current signal and the carrier motor current signals. In this particular embodiment, the noise is filtered using an equi-ripple, lowpass filter, having 32 taps, a pass frequency of 0.020 Hz and a stop frequency of 0.060 Hz. As set forth in box 156, the method 150 proceeds by combining the filtered table motor current signal with the filtered motor current signal, the optical signal, and the thermal signal for each carrier. Finally, as set forth in the box 158, the method 150 proceeds by detecting a peak in at least one combined signal, wherein the peak indicates the process endpoint.

The peak detection in the box 158 is performed in the method 150 by the method 170 in FIG. 11. This peak detection method is actually a part of the LabVIEW™ application's software discussed above, but the invention is not so limited. The method 170 begins by determining a high value of an initial peak and a low value in the following trough as is set forth in the boxes 172, 173. The method 170 then proceeds by estimating a value for the endpoint process as set forth in the box 174. The estimated value for the endpoint is then taken as an adjustable percentage of the difference between the high and low values as discussed above for the method 50 of FIG. 5. The method 170 then proceeds, as set forth in the box 175 by performing a least squares fit on a parabola fitted to the data signals to identify the peaks therein and each peak that does not match or exceed the estimated value is filtered out of the analysis as set forth in the box 176. The method 170 concludes by identifying a remaining peak as the process endpoint as set forth in the box 177. The method 170 is performed for each of the data signals for which it is applicable. In the particular embodiment illustrated, this includes the data signals 182, 184 and 188.

To further an understanding of the invention in both of these aspects, the manner in which the method 150 is implemented using the apparatus 90 in FIG. 9 shall be discussed in more detail. The discussion assumes that a CMP process has already begun in accordance with standard operating procedures. The sensors 102, 106, 110, and 112 are monitoring the operation of the CMP process.

The data collection unit 120 receives the data signals (not shown) generated by the sensors 102, 106, 110, and 112 as set forth in the box 152 of FIG. 10. Thus, the data collection unit performs the function of the data collection unit 42 of FIG. 4 by receiving the data signals as set forth in box 32 of FIG. 3. Returning to FIGS. 9 and 10, the data collection unit 120 then transmits the received data signals to the computer 92 over the bus system 96.

The computer 92, in this particular embodiment, is programmed with the LabVIEW™ (Version 5.0) software application discussed above. The computer 92, under the execution of this software application, filters the data signals as set forth in the box 154 and combines the data signals as set forth in the box 156 of FIG. 10. The computer 92 generates a combined data signal for each of the carriers 95. Each combined data signal is generated from the table motor current signal and the respective carrier motor current, optical, and thermal data signals.

FIG. 12 illustrates some exemplary, theoretical, data signals such as may be combined in this manner, including a table motor current signal 182, a carrier motor current signal 184, an optical signal 186, and a thermal signal 188. FIG. 13 illustrates two combined data signals 190, 192 as may be generated from the signals of FIG. 12, the combined data signal 190 resulting from adding, and the combined data signal 192 resulting from multiplying the signals of FIG. 12. Thus, the computer 92, as programmed, provides the function of the signal combiner 48 of the signal analysis unit 44 in FIG. 4 to perform the combining function set forth in the box 34 of FIG. 3.

Returning again to FIGS. 9 and 10, the computer 92 also detects a peak in at least one of the combined data signals, wherein the peak indicates the process endpoint, as is set forth in the box 158 of FIG. 10. As will be apparent to those skilled in the art having the benefit of this disclosure, the endpoint will not be reached simultaneously for all the carriers. Thus, the "process endpoint" may be defined in a variety of ways. For instance, the process endpoint may be defined as the point in the CMP process at which all the carriers reach their respective endpoint or at the point where half of the carriers reach their respective endpoint.

The apparatus 90 includes five carriers 95, although not all may be used at the same time. The particular embodiment illustrated defines the process endpoint depending on the number of carriers 95 in use as set forth in Table 1 below.

TABLE 1

| No. of Carriers in Use | Minimum No. of Carrier Endpoints to Indicate Process Endpoint |
|---|---|
| 1 | 1 |
| 2 | 2 |
| 3 | 2 |
| 4+ | 3 |

However, other embodiments may define the process endpoint differently. For instance, alternative embodiments might stop the process for each carrier 95 independently as each carrier 95 reaches it respective endpoint. Note, however, that the table current would be unable to distinguish among individual carriers in such an embodiment.

The computer 92 therefore analyzes each combined data signal to detect a process endpoint indicating peak. The computer 92, under the direction of the applications software, analyzes each combined signal in accord with the method 170 in FIG. 11. Thus, the computer 92 also performs the function of the peak identifier 49 in the signal analysis unit 44 of FIG. 4 in accord with the box 36 of FIG. 3. When the predetermined number of carrier endpoints are detected, then the computer 92 issues a stop command to the CMP tool 94 over the bus system 96. Thus, the computer 92 also performs the function of the signal generating unit 46 of FIG. 4 to generate a signal 45 indicative of the process endpoint.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for detecting a process endpoint, the method comprising:

receiving a first data signal and a second data signal;

combining the first data signal and the second data signal to generate a combined data signal; and detecting a peak in the combined data signal, wherein the peak indicates the process endpoint.

2. The method of claim 1, wherein receiving the first data signal and the second data signal includes receiving at least one of a carrier motor current signal, a table motor current signal, a polishing table temperature signal, a pad temperature signal, a reflected white-light optical signal, and a reflected fixed wavelength optical signal.

3. The method of claim 1, wherein combining the first data signal and the second data signal includes at least one of:

filtering noise from at least one of the first and second data signals;

weighting at least one of the first and second data signals;

adding the first and second data signals; and multiplying the first and second data signals.

4. The method of claim 1, wherein detecting the peak in the combined data signal includes:

determining a high value for an initial peak;

determining a low value for a following trough;

estimating a value for the endpoint process from the high value and the low value;

identifying subsequent peaks in the combined data signal;

filtering out a subsequent peak identified by the least squares fit that is less than the estimated value; and identifying a remaining subsequent peak as the process endpoint.

5. The method of claim 1, wherein identifying subsequent peaks includes performing a least squares fit on a parabola fitted to the combined data signal.

6. The method of claim 1, further comprising:

chemically-mechanically polishing a wafer on a polishing table;

sensing the chemical-mechanical polishing to generate the first data signal and the second data signal; and transmitting the first data signal and the second data signal.

7. The method of claim 1, wherein the first data signal is measured in a first unit and the second data signal is measured in a second unit, wherein the first unit and the second unit are not related by a proportionality.

8. An apparatus for detecting a process endpoint, the apparatus comprising:

a data collection unit, capable of receiving a plurality of data signals; and a signal analysis unit capable of:

combining the plurality of data signals received through the data collection unit to generate a combined data signal; and identifying a peak in the combined data signal indicative of the process endpoint.

9. The apparatus of claim 8, wherein the apparatus includes a computer programmed to combine the plurality of data signals to generate the combined data signal and identify the peak in the combined data signal indicative of the process endpoint.

10. The apparatus of claim 9, wherein the computer is further programmed to generate a signal indicating the process endpoint.

11. The apparatus of claim 8, wherein the signal analysis unit is further capable of filtering at least one of the plurality of data signals.

12. The apparatus of claim 8, wherein the at least one of the plurality of data signals is selected from the group comprising: a carrier motor current signal, a table motor current signal, a polishing table temperature signal, a pad temperature signal, a reflected white-light optical signal, and a reflected fixed wavelength optical signal.

13. The apparatus of claim 8, wherein combining the plurality of data signals to generate the combined data signal includes adding the plurality of data signals.

14. The apparatus of claim 8, wherein combining the plurality of data signals to generate the combined data signal includes multiplying the plurality of data signals.

15. The apparatus of claim 8, wherein identifying the peak in the combined data signal includes:

determining a high value for an initial peak;

determining a low value for a following trough;

estimating a value for the endpoint process from the high value and the low value;

identifying subsequent peaks in the combined data signals;

filtering out a subsequent peak identified by the least squares fit that is less than the estimated value; and identifying a remaining subsequent peak as the process endpoint.

16. The apparatus of claim 15, wherein identifying subsequent peaks in the received data signals includes performing a least squares fit.

17. The apparatus of claim 8, further comprising:

a chemical-mechanical polishing tool; and a plurality of sensors, each sensor being capable of monitoring the operation of the chemical-mechanical polishing tool and transmitting at least one of the plurality of data signals.

18. The apparatus of claim 17, wherein the plurality of sensors is capable of monitoring at least one of the carrier motor current, the table motor current, the polishing table temperature, the pad temperature, a reflected white-light optical signal, and a reflected fixed wavelength optical signal.

19. The apparatus of claim 8, further comprising a signal generating unit capable of generating a signal indicating the process endpoint upon identification of the peak indicative of the process endpoint.

20. The apparatus of claim 19, wherein the signal indicating the process endpoint is a stop signal.

21. The apparatus of claim 8, wherein the plurality of data signals include at least a first data signal and a second data signal, wherein the first data signal and the second data signal are measured in different units that are not related by a proportionality.

22. A computer-readable, program storage device encoded with instructions that, when executed by a computer, perform a method for detecting a process endpoint, the method comprising:

combining a first data signal from a first sensor and a second data signal from a second sensor different from the first sensor to generate a combined data signal, wherein the first data signal and the second data signal are different; and detecting a peak in the combined data signal, wherein the peak indicates the process endpoint.

23. The computer-readable, program storage device of claim 22, wherein combining the first data signal and the second data signal includes combining a data signal selected from the group comprising: a carrier motor current signal, a table motor current signal, the polishing table temperature signal, the pad temperature signal, a reflected white-light optical signal, and a reflected fixed wavelength optical signal.

24. The computer-readable, program storage device of claim 22, wherein combining the first data signal and the second data signal includes at least one of:

filtering at least one of the first data signal and the second data signal;

weighting at least one of the first data signal and the second data signal;

adding the first data signal and the second data signal; and multiplying the first data signal and the second data signal.

25. The computer-readable, program storage device of claim 22, wherein detecting the peak in the combined data signal includes:

determining a high value for an initial peak;

determining a low value for a following trough;

estimating a value for the endpoint process from the high value and the low value;

performing a least squares fit on the combined data signal to identify subsequent peaks therein;

filtering out a subsequent peak identified by a least squares fit that is less than the estimated value; and identifying a remaining subsequent peak as the process endpoint.

26. The computer-readable, program storage device of claim 22, wherein the first data signal is measured in a first unit and the second data signal is measured in a second unit, and wherein the first unit and the second unit are not related by a proportionality.

27. A method for detecting a process endpoint, the method comprising:

receiving a data signal;

detecting a peak indicative of the process endpoint in the received data signal, the peak detection including:

determining a high value for an initial peak;

determining a low value for a following trough;

estimating a value for the endpoint process from the high value and the low value;

identifying subsequent peaks in the received data signal;

filtering out a subsequent peak less than the estimated value; and identifying a remaining subsequent peak as the process endpoint.

28. The method of claim 27, wherein identifying subsequent peaks includes performing a least squares fit.

29. The method of claim 27, wherein receiving the data signal includes receiving a data signal selected from the group comprising: a carrier motor current signal, a table motor current signal, a polishing table temperature signal, and a pad temperature signal.

30. The method of claim 27, wherein filtering noise includes filtering noise with a filter selected from the group comprising a lowpass filter, a lowpass equi-ripple filter, a bandpass filter, an equi-ripple bandpass filter, an infinite impulse response filter, and a finite impulse response filter.

31. The method of claim 30, wherein filtering noise with the equi-ripple lowpass filter includes filtering noise with an equi-ripple lowpass filter having 32 taps, a pass frequency of 0.020 Hz, and a stop frequency of 0.060 Hz.

32. The method of claim 27, further comprising:

chemically mechanically polishing a wafer on a polishing table;

sensing the chemically-mechanically polishing process; and generating the data signal based on the sensing.

33. An apparatus for detecting a process endpoint, the apparatus comprising:

a data collection unit, capable of receiving one or more data signals; and a signal analysis unit capable of identifying a peak in the one or more data signals indicative of the process endpoint, including:

combining the one or more data signals to form a combined data signal;

determining a high value for an initial peak;

determining a low value for a following trough;

estimating a value for the endpoint process from the high value and the low value;

identifying subsequent peaks in the combined data signal;

filtering out a subsequent peak less than the estimated value; and identifying a remaining subsequent peak as the process endpoint.

34. The apparatus of claim 33, wherein identifying subsequent peaks includes performing a least squares fit.

35. The apparatus of claim 33, wherein the apparatus includes a computer programmed to:

identify the peak in the combined data signal indicative of the process endpoint; and generate a signal indicating the process endpoint.

36. The apparatus of claim 33, wherein the signal analysis unit is further capable of filtering the received data signal.

37. The apparatus of claim 33, wherein at least one of the one or more data signals is selected from the group comprising: a carrier motor current signal, a table motor current signal, a polishing table temperature signal, a pad temperature signal, a reflected white-light optical signal, and a reflected fixed wavelength optical signal.

38. The apparatus of claim 33, wherein combining the one or more data signals to generate the combined data signal includes adding the one or more data signals.

39. The apparatus of claim 33, wherein combining the one or more data signals to generate the combined data signal includes multiplying the one or more data signals.

40. The apparatus of claim 33, further comprising:

a chemical-mechanical polishing tool; and one or more sensors, each sensor being capable of monitoring the operation of the chemical-mechanical polishing tool and transmitting at least one of the one or more data signals.

41. The apparatus of claim 40, wherein each of the one or more sensors is capable of monitoring at least one of the carrier motor current, the table motor current, the polishing table temperature, and the pad temperature.

42. The apparatus of claim 33, further comprising a signal generating unit capable of generating a signal indicating the process endpoint.

43. The apparatus of claim 42, wherein the signal indicating the process endpoint is a stop signal.

* * * * *